United States Patent [19]

Shimizu et al.

[11] Patent Number: 4,853,048

[45] Date of Patent: Aug. 1, 1989

[54] PERMANENT MAGNETIC ALLOY COMPRISING GOLD, PLATINUM AND COBALT

[75] Inventors: Shotaro Shimizu; Yosuke Sakakibara, both of Tokyo, Japan

[73] Assignee: Citizen Watch Co., Ltd., Tokyo, Japan

[21] Appl. No.: 154,493

[22] Filed: Jan. 29, 1988

Related U.S. Application Data

[63] Continuation-in-part of Ser. No. 947,709, Dec. 30, 1986, abandoned.

[30] Foreign Application Priority Data

Feb. 7, 1986 [JP] Japan ..... 61-25593

[51] Int. Cl.[4] ..... C22C 5/02

[52] U.S. Cl. ..... 148/300; 420/509; 420/510

[58] Field of Search ..... 420/509, 510; 148/300; 63/2

[56] References Cited

U.S. PATENT DOCUMENTS

| | | | |
|---|---|---|---|
| 1,946,231 | 2/1934 | Nowack | 420/510 |
| 3,238,040 | 3/1966 | Durer et al. | 420/510 |
| 3,591,373 | 7/1971 | Shimizu et al. | 420/510 |

FOREIGN PATENT DOCUMENTS

| | | | |
|---|---|---|---|
| 14408 | 1/1985 | Japan | 148/300 |

*Primary Examiner*—Robert McDowell

*Attorney, Agent, or Firm*—Koda and Androlia

[57] ABSTRACT

A permanent magnetic alloy mainly composed of gold for making magnetic personal ornaments comprises 50 to 75 weight % gold, 12 to 40 weight % palladium and 3 to 15 weight % cobalt. The alloy is gold or white gold in color and can be plastically deformed to a desired shape. The 12, 14 and 18 Karat gold alloys have maximum energy products of 3.0, 2.2 and 0.9 MGOe, respectively.

3 Claims, 4 Drawing Sheets

PERMANENT MAGNETIC ALLOY COMPRISING GOLD, PLATINUM AND COBALT

This is a continuation-in-part of application Ser. No. 947,709, filed 12/30/86, now abandoned.

BACKGROUND OF THE INVENTION

1. Field of the Invention

This invention relates to a permanent magnetic alloy comprising precious metals and more particularly to a magnetic alloy mainly composed of gold for use in magnetic personal ornaments.

2. Description of the Related Art

It has been known for a long time that magnetism has an effect upon the human body, and since an effect of magnetism for medical purposes was recently confirmed by public agencies, many kinds of magnetic health implements have been commercialized.

In the field of the magnetic health implements, there are objects called magnetic personal ornaments such as magnetic necklaces, magnetic bracelets and magnetic rings. These magnetic ornaments are that small ferrite magnet or rare-earth magnet pieces are enclosed in metallic receptacles and connected in the shape of a chain. Therefore, they are valued as health implements and accessories, but hardly valued as jewelry. In the circumstances, a precious metal magnet is ardently desired which is mainly composed of gold, platinum, silver or the like and capable of constituting a magnetic alloy by itself.

As a precious metal magnet, a platinum (Pt) - cobalt (Co) alloy magnet is known. This is an order-disorder transition type of alloy containing 77% Pt and exhibits very strong magnetic performance (hereinafter the term "percent, %" means a weight percent). However, an alloy containing less than 85% Pt is not publicly approved as a platinum alloy and it is thought that it has little value as jewelry.

On the other hand, as a magnetic alloy containing gold (Au), an alloy comprising Au, nickel (Ni) and iron (Fe) (Japanese unexamined patent application 57-5833) and an alloy comprising Pt, Au and Fe (U.S. Pat. No. 3,591,373) are known.

The former (hereinafter referred to as conventional alloy ANF) is an alloy containing 75% Au (equivalent to 18 Karat), but its coercive force is about 500 oersteds. A general chain-shaped ornament has a disadvantageous shape for magnetizing, and the coercive force of around 500 oersteds is not enough to provide a sufficient remanence. In order to enable the magnetic ornament to produce a medical effect, it is thought necessary for the ornament to have a remanence of at least 500 gausses (G). In order to obtain this value by a general chain-shaped ornament, as will be explained later, a coercive force of at least 1300 to 1500 oersteds (Oe) is required.

On the other hand, the latter alloy is not approved as a gold alloy, because it is mainly composed of Pt and contains less than 50% Au. Unless the alloy contains at least 50% gold (12 Karat), it would have no such commercial value that it can be called gold jewelry.

SUMMARY OF THE INVENTION

Therefore, one of the objects of the invention is to develop a magnetic alloy containing 50% or more gold, having an ornamental shape and attaining a remanence of 500 G or more.

DETAILED DESCRIPTION OF THE PREFERRED EMBODIMENTS

For the above object, according to the invention, the magnetic properties of the alloys mainly composed of gold (Au), platinum (Pt) and cobalt (Co) and also alloys in which iron (Fe), nickel (Ni), copper (Cu), palladium (Pd), silver (Ag), or the like are added to the above alloys were examined, and ranges of composition having excellent magnetic performance were determined.

A Pt-Co alloy is typical of order-disorder transition type permanent magnetic alloys, and an alloy having a 1:1 atomic ratio composition (50 atomic percent Pt, that is, 77 weight % Pt) exhibits an extremely high coercive force in a process of transforming to the ordered state by heat treatment.

In this connection, when Au is added to this Pt-Co alloy to produce an Au-Pt-Co ternary alloy, a two-phase coexistence condition having $\alpha_1$ phase mainly composed of Au and $\alpha_2$ phase mainly composed of Pt-Co is obtained.

In this case, in the $\alpha_1$ phase mainly composed of Au, small amounts of Pt and Co are dissolved, while in the $\alpha_2$ phase mainly composed of Pt-Co, Au is hardly dissolved. Therefore, the magnetic properties of the Pt-Co alloy appear in proportion to the relative amount of the $\alpha_2$ phase.

The present invention has been made from the above viewpoint and will now be described with reference to the embodiments.

A total of 30 kinds of alloys comprised of 50 to 75% Au, 12 to 42% Pt and 2 to 15% Co and alloys in which Fe, Ni, Cu, Pd and Ag are added to the above alloys were prepared by an induction melting method, then, made into wire by plastic deformation and cut into test pieces for measurement.

When these alloys were cooled rapidly by plunging into water from a temperature of 900° C. which exceeds an order-disorder transition temperature, they were in a disordered state. This treatment is called a disordering. In this disordered state, these alloys permit plastic deformation such as rolling and wiredrawing.

Table 1 lists the compositions of these alloys.

Table 2 lists the maximum values of the magnetic properties varying with aging time when after the disordering, these alloys were heated to a temperature below the transition temperature for transforming to the ordered state (this treatment is called an aging).

Figure 2:
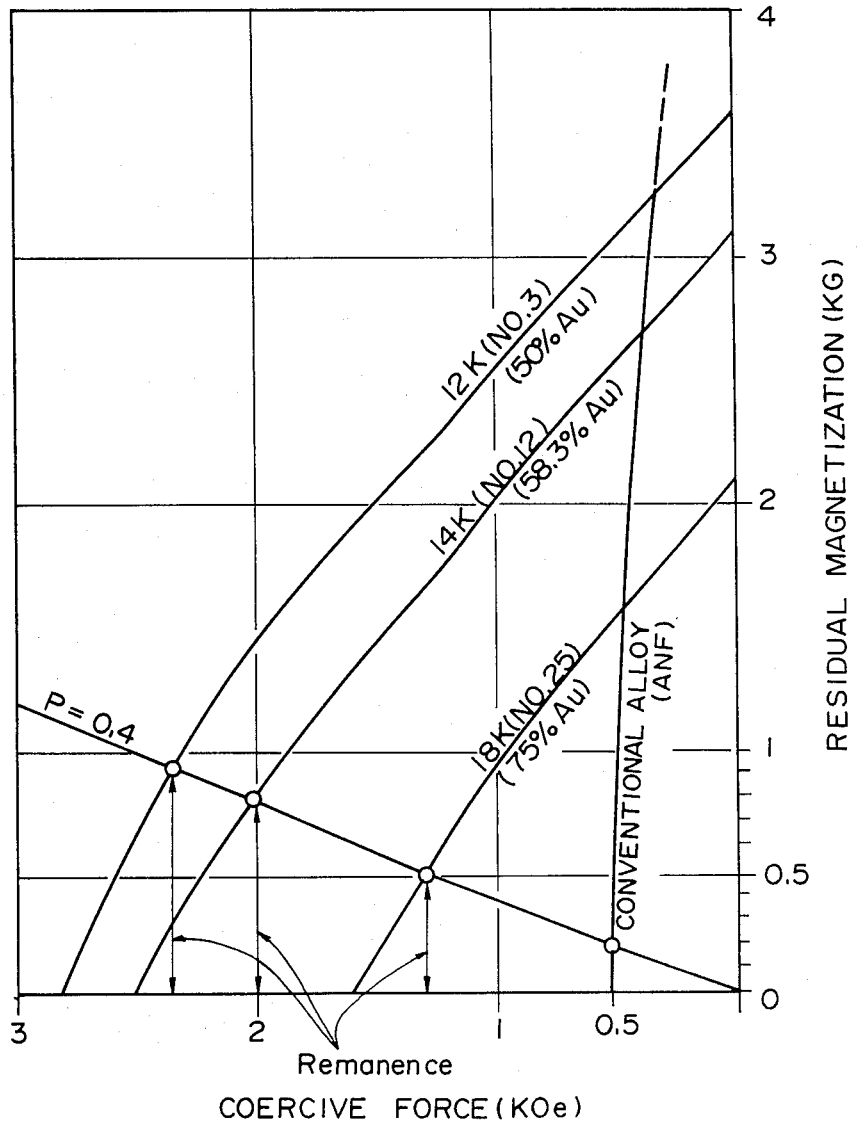
FIG. 2 is a diagram showing demagnetizing curves of alloys of the invention in comparison with the conventional alloy.

FIG. 2 shows demagnetizing curves exhibiting the magnetic properties obtained in alloys Nos. 3, 12 and 25 of the embodiment of the invention and also shows the properties of the above-mentioned conventional alloy (ANF) for comparison. Alloys Nos. 3, 12 and 25 are gold alloys equivalent to 12 K (Karat), 14 K and 18 K, respectively, and it is evident that with increase in gold content, the magnetization and the coercive force are lowered.

As mentioned before, the magnetic personal ornament is generally formed into a plain chain shape and magnetized in the direction of its thickness for use. As a result, it is used in an extremely disadvantageous condition where its permeance coefficient, P (a value of the condition of use of the magnet) is low, and its permeance coefficient is around 0.4.

In FIG. 2, a line of P=0.4 is plotted. The intersection of this line with each of the demagnetizing curves is called a work point magnetization and serves as the standard of a remanence (Bd) actually obtained in the shape of the ornament.

As shown in FIG. 2, the 12 K alloy has a remanence (Bd 0.4) of 940 G, the 14 K alloy, 800 G, and 18 K alloy, 520 G. In contrast, it is found that the above-mentioned conventional alloy (ANF) has a remanence of only about 200 G. Furthermore, in order to obtain a remanence of 500 G or more in a plain ornament shape having a permeance coefficient of P≃0.4, it can be read from FIG. 2 that a coercive force of at least 1.3 to 1.5 kilo-oersteds (KOe) is necessary.

Table 2 shows a saturation magnetization, $4\pi$Is (KG); residual magnetization, Br (KG); coercive force, Hc (KOe); maximum energy product, (BH) max (MGOe); and remanence, Bd 0.4 (G) at a permeance coefficient of P=0.4, in the aged condition in which the maximum Bd 0.4 value was obtained for each alloy.

Figure 3:
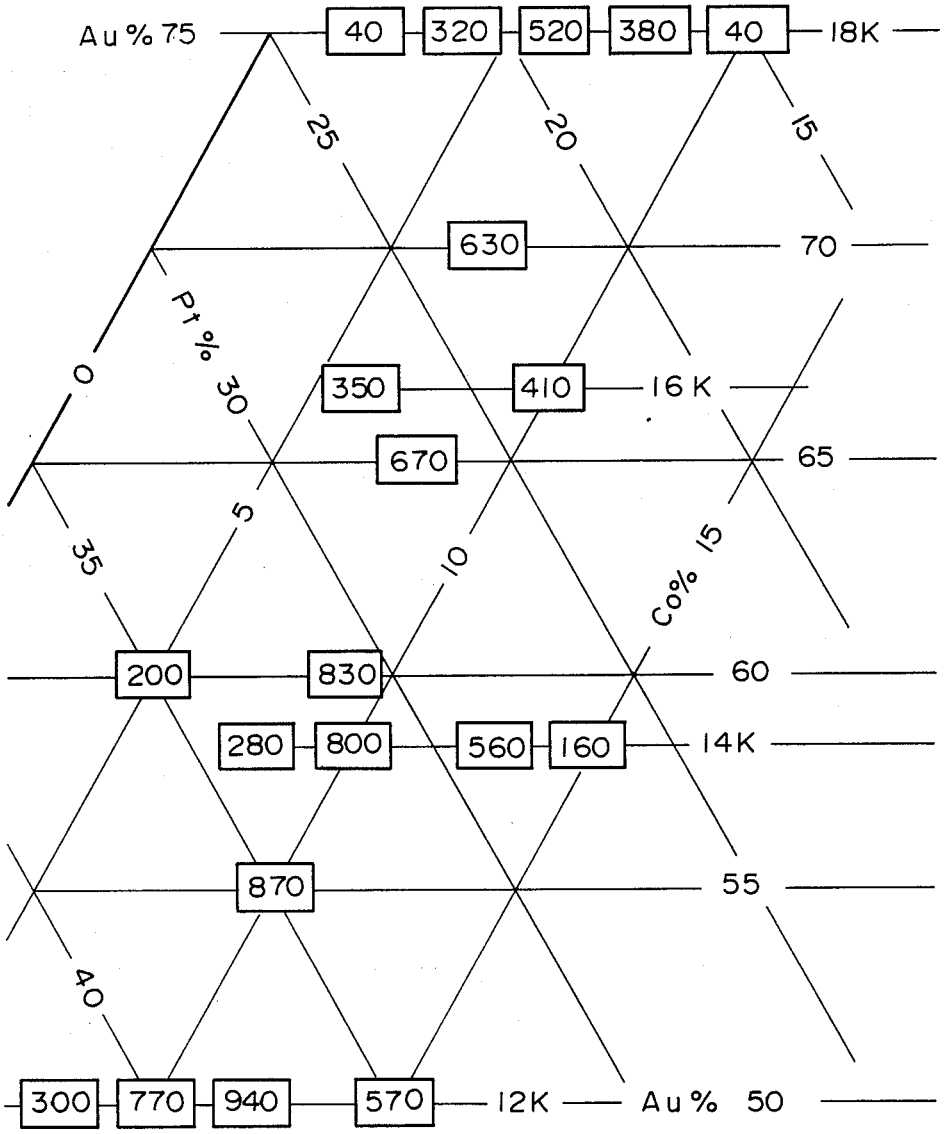
FIG. 3 is a ternary composition diagram showing a distribution of remanences of the embodiment.
Figure 4:
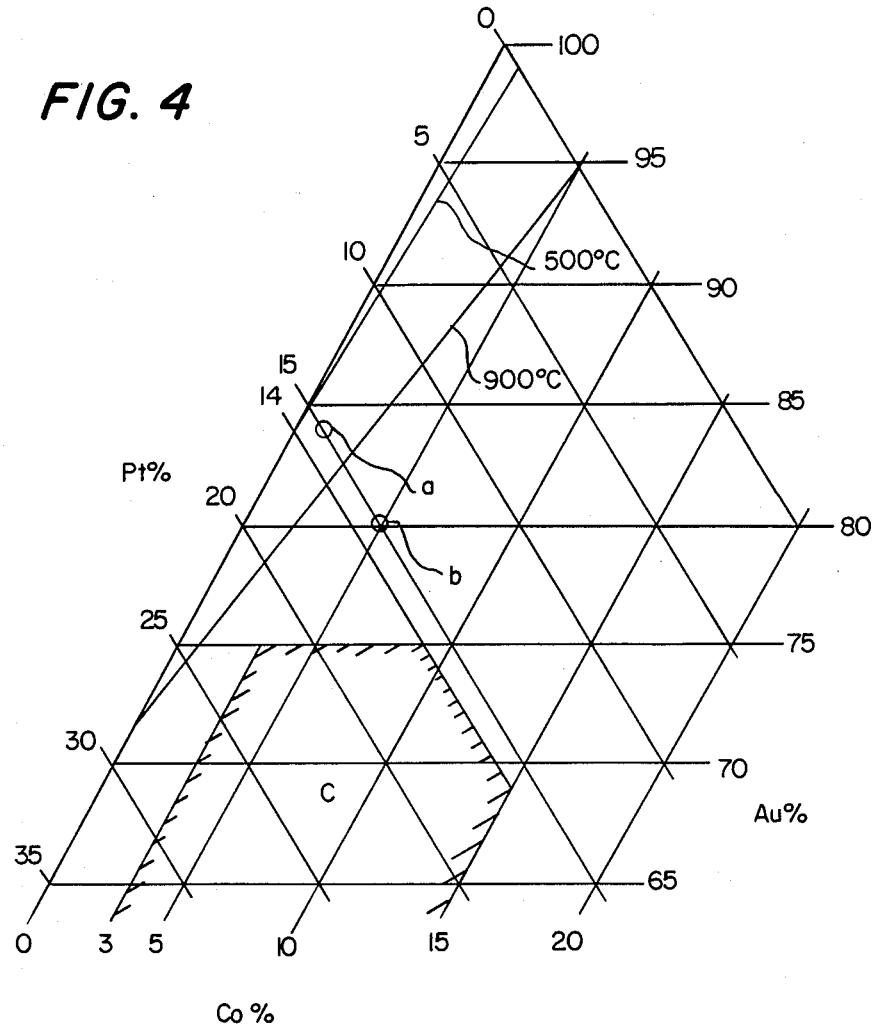

FIG. 3 is a ternary composition diagram showing each remanence (Bd 0.4) obtained in Au-Pt-Co ternary alloys of the embodiment of the present invention.

Reason for Limiting Composition

As recognized from Tables 1 and 2 and FIGS. 2 and 3, it is evident that the higher performance is obtained as the Au content decreases. However, the object of the invention is to provide a composition of Au exceeding 50%, and the lower limit of Au is set to 50% (12 K).

Also, when Au is contained 75% (18 K), the desired remanence is kept, but if the Au content is increased to 20 K and 22 K, it is assumed that the required remanence is not obtainable any more. As a result, the upper limit of Au is set to 75% (18 K).

In the 12 Kalloy, when the Pt content exceeds 40%, the remanence suffers rapid deterioration. On the other hand, in the 18 K alloy, when the Pt content is less than 16%, the required remanence is not obtainable. Therefore, the composition range of Pt in the Au-Pt-Co ternary alloy is set to 16 to 40%.

On the other hand, as shown in alloys Nos. 29 and 30, when part of Pt is substituted with Pd, the desired remanence is obtained until the Pt content is 12%.

Therefore, in an alloy base consisting of four or more different elements, the composition range of Pt is set to 12 to 40%.

In the 12 Kalloy, the object is attained until the Co content is 15%, but it is thought that exceeding this value is useless. On the other hand, in the 18 K alloy, when the Co content is less than 3%, the performance suffers rapid deterioration. Therefore, the composition range of Co is set to 3 to 15%.

Figure 1:
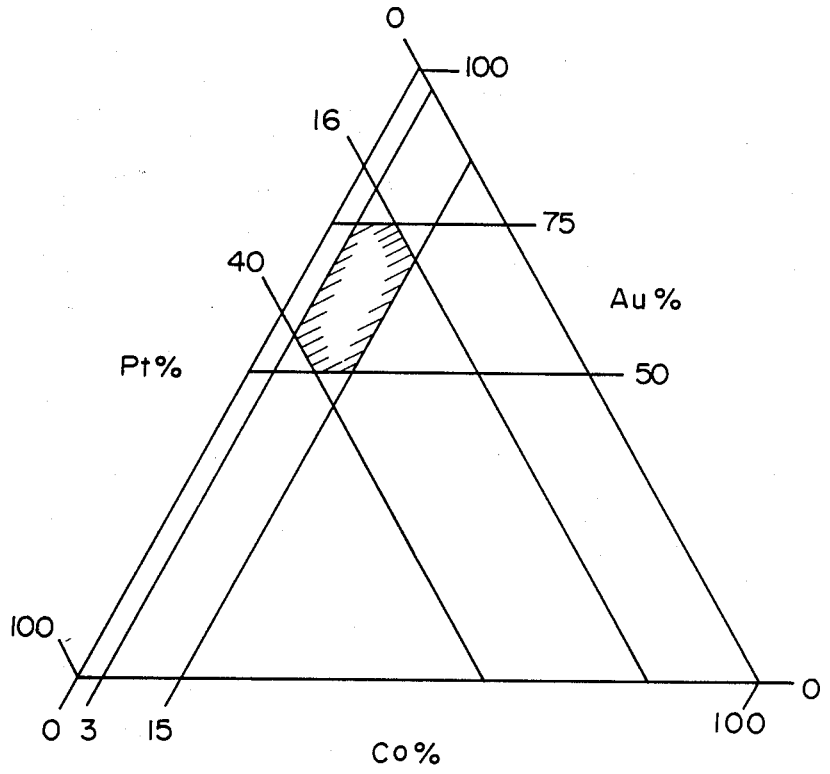
FIG. 1 is a ternary composition diagram showing composition ranges of alloys of the invention.

The range of composition limit for Au-Pt-Co ternary alloys of the present invention is shown in a composition diagram of FIG. 1.

As shown in alloys Nos. 5, 15 and 28, when part of Co is substituted with Fe, the magnetization increases and the remanence is enhanced. On the other hand, as shown in alloy No. 6, when part of Co is substituted with Ni, the remanence is slightly deteriorated. In this case, however, it has an advantage in that a water quenching is not required for disordering, so that the disordered state can be obtained by air cooling.

As shown in alloys Nos. 7, 8 and 16, when Cu and Ag are added to an Au-Pt-Co alloy, a 12 Kalloy exhibits the character of a 14 K alloy and a 14 K alloy exhibits the character of a 16 K alloy. Thus, the contents of Au and Pt can be decreased to save the material cost.

Furthermore, as shown in alloys Nos. 9, 15, 29 and 30, when part of Pt is substituted with Pd, the Pt content can be extremely decreased without deteriorating the remanence so much, and this is very advantageous from the viewpoint of the material cost.

These elements can be added singly or in combination, but it is thought useless that a total of additive amount exceeds the range of the embodiment, and therefore, they are limited to 3 to 12%.

As mentioned above, the alloys of the invention contain 50% or more gold which can be designated as gold alloys. Since each has a high coercive force, a required remanence can be maintained even in a plain-shaped ornament, and it is particularly useful for material for high-class magnetic personal ornaments, that is, magnetic jewelry.

TABLE 1

| | | Alloy composition (weight %) | | | |
|---|---|---|---|---|---|
| No. | Karat | Au | Pt | Co | Other elements |
| 1 | 12K | 50.0 | 42 | 8 | none |
| 2 | 12K | 50.0 | 40 | 10 | none |
| 3 | 12K | 50.0 | 38 | 12 | none |
| 4 | 12K | 50.0 | 35 | 15 | none |
| 5 | 12K | 50.0 | 38 | 8 | Fe 4 |
| 6 | 12K | 50.0 | 38 | 9 | Ni 3 |
| 7 | 12K | 50.0 | 33 | 10 | Ag 7 |
| 8 | 12K | 50.0 | 33 | 10 | Cu 7 |
| 9 | 12K | 50.0 | 30 | 10 | Pd 10 |
| 10 | — | 55.0 | 35 | 10 | none |
| 11 | 14K | 58.3 | 33.7 | 8 | none |
| 12 | 14K | 58.3 | 31.7 | 10 | none |
| 13 | 14K | 58.3 | 28.7 | 13 | none |
| 14 | 14K | 58.3 | 26.7 | 15 | none |
| 15 | 14K | 58.3 | 23 | 6.7 | Pd 7, Fe 5 |
| 16 | 14K | 58.3 | 22.7 | 7 | Cu 12 |
| 17 | — | 60 | 35 | 5 | none |
| 18 | — | 60 | 31 | 9 | none |
| 19 | — | 65 | 27 | 8 | none |
| 20 | 16K | 66.7 | 27.3 | 6 | none |
| 21 | 16K | 66.7 | 23.3 | 10 | none |
| 22 | — | 70 | 23 | 7 | none |
| 23 | 18K | 75 | 23 | 2 | none |
| 24 | 18K | 75 | 21 | 4 | none |
| 25 | 18K | 75 | 19 | 6 | none |
| 26 | 18K | 75 | 17 | 8 | none |
| 27 | 18K | 75 | 15 | 10 | none |
| 28 | 18K | 75 | 18 | 4 | Fe 3 |
| 29 | 18K | 75 | 14 | 4 | Pd 4, Fe 3 |
| 30 | 18K | 75 | 12 | 5 | Pd 8 |

TABLE 2

| | Magnetic properties | | | | |
|---|---|---|---|---|---|
| No. | $4\pi$ Is (KG) | Br (KG) | Hc (KOe) | (BH)max (MGOe) | Remanence Bd(0.4) (G) |
| 1 | 4.0 | 2.0 | 0.8 | 0.5 | 300 |
| 2 | 4.0 | 3.2 | 2.3 | 2.3 | 770 |
| 3 | 4.1 | 3.6 | 2.8 | 3.0 | 940 |
| 4 | 5.4 | 4.5 | 1.5 | 2.2 | 570 |
| 5 | 4.5 | 4.0 | 2.9 | 3.7 | 970 |
| 6 | 3.3 | 3.0 | 2.7 | 2.3 | 840 |
| 7 | 3.1 | 2.8 | 2.4 | 2.0 | 750 |
| 8 | 3.2 | 2.9 | 2.3 | 2.0 | 750 |
| 9 | 3.4 | 3.1 | 2.4 | 2.1 | 780 |
| 10 | 3.5 | 3.3 | 2.7 | 2.6 | 870 |
| 11 | 4.1 | 2.0 | 0.8 | 0.5 | 280 |
| 12 | 3.4 | 3.1 | 2.5 | 2.2 | 800 |

TABLE 2-continued

| No. | Magnetic properties 4π Is (KG) | Br (KG) | Hc (KOe) | (BH)max (MGOe) | Remanence Bd(0.4) (G) |
|---|---|---|---|---|---|
| 13 | 5.0 | 2.9 | 1.6 | 1.4 | 560 |
| 14 | 6.4 | 1.9 | 0.4 | 0.2 | 160 |
| 15 | 3.4 | 3.2 | 2.7 | 2.7 | 860 |
| 16 | 2.6 | 2.3 | 1.9 | 1.3 | 500 |
| 17 | 3.1 | 1.5 | 0.5 | 0.3 | 200 |
| 18 | 3.2 | 3.0 | 2.8 | 2.2 | 830 |
| 19 | 3.1 | 2.7 | 2.2 | 1.6 | 670 |
| 20 | 2.9 | 2.1 | 1.0 | 0.6 | 350 |
| 21 | 4.1 | 3.1 | 1.1 | 1.1 | 410 |
| 22 | 2.7 | 2.4 | 2.1 | 1.3 | 630 |
| 23 | 1.0 | 0.3 | 0.1 | 0.01 | 40 |
| 24 | 1.6 | 1.3 | 1.0 | 0.4 | 320 |
| 25 | 2.3 | 2.1 | 1.6 | 0.9 | 520 |
| 26 | 3.1 | 2.3 | 1.1 | 0.7 | 380 |
| 27 | 4.5 | 1.4 | 0.1 | 0.06 | 40 |
| 28 | 2.7 | 2.4 | 1.5 | 1.1 | 510 |
| 29 | 2.5 | 2.3 | 2.0 | 1.3 | 620 |

TABLE 2-continued

| No. | Magnetic properties 4π Is (KG) | Br (KG) | Hc (KOe) | (BH)max (MGOe) | Remanence Bd(0.4) (G) |
|---|---|---|---|---|---|
| 30 | 2.3 | 1.9 | 1.6 | 0.8 | 500 |

What is claimed is:

1. A permanent magnetic alloy consisting essentially of 50 to 75% by weight gold, 16 to 40% by weight platinum and greater than 5 but less than or equal to 15% by weight cobalt, wherein the alloy is composed of a gold rich phase and an ordered platinum cobalt phase, and that the alloy has a coercive force over 1,300 oersted.

2. A permanent magnetic alloy consisting essentially of 50 to 75% by weight gold, 12 to 40% by weight platinum, greater than 5 but less than or equal to 15% by weight cobalt and 3 to 12% by weight at least one metal selected from the group consisting of iron, nickel, copper, palladium and silver wherein the alloy is composed of a gold rich phase and an ordered platinum cobalt phase and that the alloy has a coercive force over 1,300 oersted.

3. The permanent magnetic alloy of claim 2, wherein said permanent magnetic alloy has a remanence over 500 gauss.

* * * * *